US006565660B1

(12) United States Patent
Wagner et al.

(10) Patent No.: US 6,565,660 B1
(45) Date of Patent: May 20, 2003

(54) ADHESIVE APPLICATOR DEVICE

(75) Inventors: Uwe Wagner, Gütersloh (DE); Gerhard Haubrok, Enger (DE)

(73) Assignee: Reinhard Düspohl Maschinenbau GmbH, Gütersloh (DE)

( * ) Notice: Subject to any disclaimer, the term of this patent is extended or adjusted under 35 U.S.C. 154(b) by 0 days.

(21) Appl. No.: 09/508,270

(22) PCT Filed: Jun. 24, 1999

(86) PCT No.: PCT/EP99/04395

§ 371 (c)(1),
(2), (4) Date: May 4, 2000

(87) PCT Pub. No.: WO00/02667

PCT Pub. Date: Jan. 20, 2000

(30) Foreign Application Priority Data

Jul. 9, 1998 (DE) ..... 198 30 728

(51) Int. Cl.[7] ..... B05C 5/00

(52) U.S. Cl. ..... 118/673; 118/419; 118/712; 239/455; 239/563

(58) Field of Search ..... 118/675, 669, 118/673, 679, 712, 410, 419; 156/357, 390; 425/466, 467; 239/563, 566, 589, 592, 594, 451, 578, 587.1, 455, 456; 428/381, 380; 68/200; 137/602

(56) References Cited

U.S. PATENT DOCUMENTS 4,248,579 A * 2/1981 Maejima ..... 425/227
4,502,304 A * 3/1985 Hopkins ..... 68/200
5,679,387 A * 10/1997 Cloeren et al. ..... 425/381
5,893,951 A * 4/1999 Madrzak et al. ..... 118/413

FOREIGN PATENT DOCUMENTS

DE 4130432 A1 * 3/1993

* cited by examiner

*Primary Examiner*—Richard Crispino
(74) *Attorney, Agent, or Firm*—Browdy and Neimark, P.L.L.C.

(57) ABSTRACT

The applicator device (AV) for hot-melt adhesive (HK) comprises a housing (1) with an adhesive feeder element (2) and an adjustable nozzle slot (3) to let out the adhesive by pressure. The nozzle slot (3) can be adjusted by means of two nozzle sliders (4) that can be displaced linearly and continuously towards each other from a zero position to a maximum open position with the purpose of adjusting the width (B) of the adhesive applicator. Both sliders (4) are displaced synchronously or independently towards each other, whereby both sliders (4) can be displaced towards each other by the same distance and/or by a different distance from the center (0) of the application width (B) of the nozzle slot (3).

17 Claims, 4 Drawing Sheets

ADHESIVE APPLICATOR DEVICE

CROSS REFERENCE TO RELATED APPLICATION

The present application is the national stage under 35 U.S.C. 371 of PCT/EP99/04395, filed Jun. 24, 1999.

The present invention comprises a device for the application of hot-melt adhesive onto materials such as foils, paper, laminates, veneers, etc., with a housing that includes an adhesive feeder element and adjustable nozzle slot to let out the adhesive, whereby the applicator device forms a so-called slot nozzle.

In known applicator devices of this kind, the housing has a nozzle slot across almost its whole width whose application width can be changed by means of various masks made of metal sheets. Depending on the width of the desired or required nozzle slot, the respective mask has to be exchanged which requires the applicator device to be dismantled, which is awkward and time-consuming.

During a production stop, air can enter the device and harden the adhesive because the nozzle slot is open. In order to avoid this, the nozzle slot is generally taped closed by hand which is often not sufficient and the adhesive hardens anyway, which requires extensive cleaning of the device.

The object of the invention is to avoid the above drawbacks by designing the nozzle slot of the adhesive applicator device in such a way that it is easily and individually adjustable to the respective application width without the applicator device having to be dismantled, so that during a production stop the nozzle slot can be closed, thereby protecting the adhesive from any exterior influence.

This object of the invention is solved by the characteristic features of claim 1 of this patent.

In addition, the adhesive must be protected against hardening by means of an advantageous route from the feeder element to the exit from the nozzle slot.

This object of the invention is solved by the characteristic features of claims 12 and 13 of this patent.

Furthermore, the width of the nozzle slot must be easily manually or automatically adjustable according to the width or the shape of the work piece.

These objects are solved by claims 14 and 15.

Advantageous further embodiments of the solutions are contained in the rest of the subclaims.

In the present device for the application of hot-melt adhesive, the characteristic features of the invention provide the following advantages:

1. The application width of the nozzle slot of the applicator device can be continuously and individually adjusted from a minimum (zero) to a maximum opening position by means of nozzle sliders, whereby this adjustment can be carried out without any dismantling of the applicator device. The sliders are manually displaced by means of threaded spindles.
2. The size of the displacement of the sliders can be selected either through synchronous displacement from the zero position to both sides or through separate displacement, whereby the application width for the respective work piece can be individually set, i.e. application can be right in the middle, just on one side or more on one side than the other.
3. The nozzle sliders are formed by strips that are V-shaped in profile and that have tongues or tongue-shaped swords arranged at the longitudinal ends facing the zero position, and these V-shaped slider strips with tongues are positioned in respective slider guides and the slider slot, and because the adhesive is to be applied by means of pressure, the slider strips with the tongues (swords) are firmly pressed to the opposing surfaces of the slider guides and the nozzle slot, so that in any nozzle width setting as well as in the closed position, the slot nozzle (whose tongues (swords) on the longitudinal ends lie adjacent to each other when in the zero position) is sealed securely against the exterior.
4. This tight guide mechanism and the tight closure of the slides in the zero position results in a closed adhesive application system, so that when the device is stopped the adhesive cannot be affected from the exterior (e.g. by air) and, therefore, cannot harden.
5. The adhesive feeder element in the device has been advantageously designed in that the movement of the hot-melt adhesive is constant from its entry to its exit, whereby there are no dead corners in which the adhesive could harden.
6. The whole device is simply and inexpensively constructed from a few components, is easy to install, does not require constant maintenance due to the adjustable nozzle slot and the guide mechanism, and can be used for the horizontal or vertical application of adhesive to the various moving materials.
7. The width of the nozzle slot is easily and manually continuously adjustable to the width of the work piece by means of threaded spindles and linear guides.
8. The adjustment of the nozzle width also depends on the width of the work piece moving through and the direction of the movement (straight, diagonal, zig-zag), and can be carried out electronically by means of sensors;
9. A distance pick-up senses the respective width of the work piece moving through and controls an adhesive dosing apparatus for precise adhesive application.

The drawings show an embodiment of the invention which will be explained in more detail below.

Figure 1:
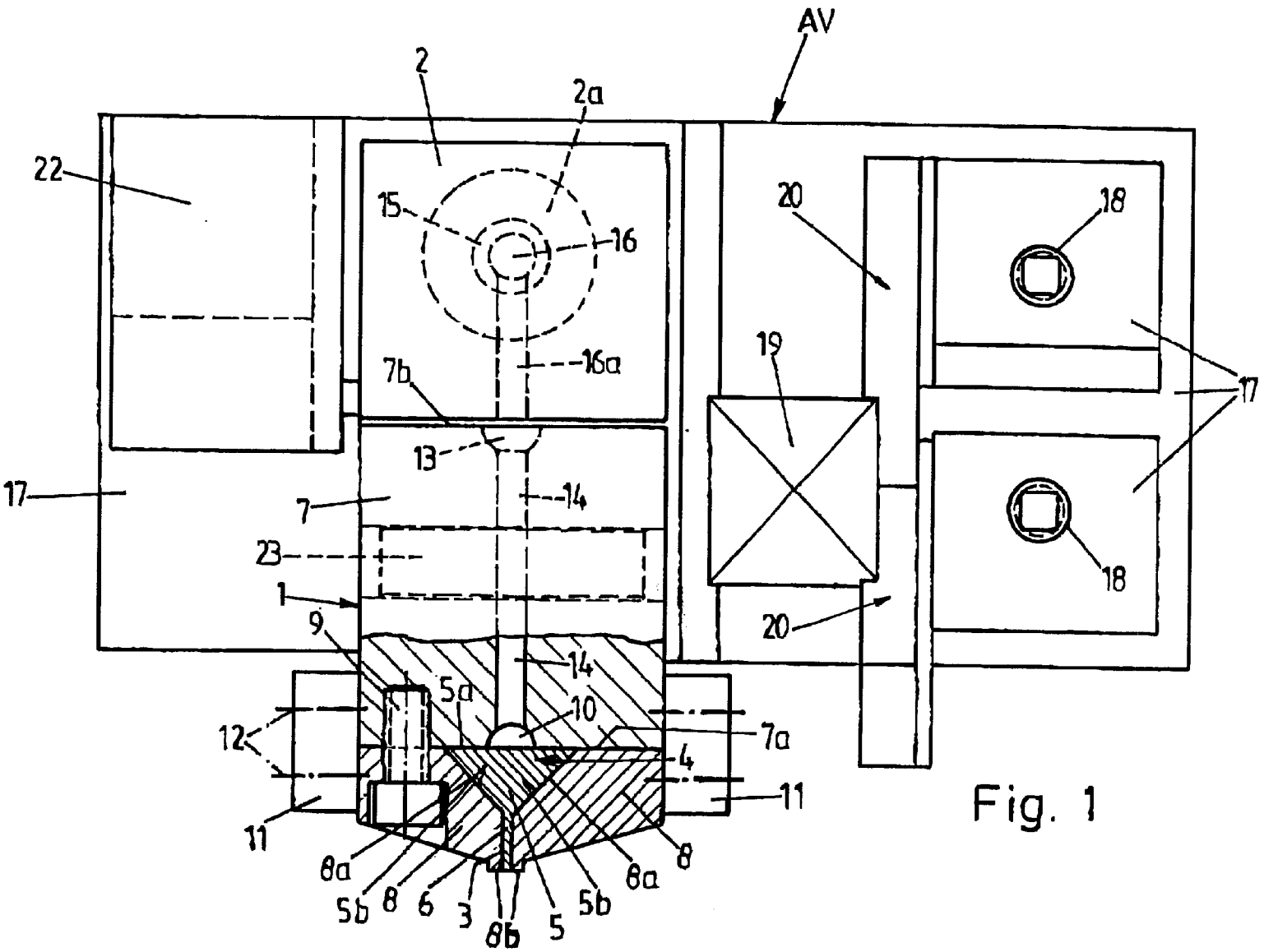
FIG. 1 shows an adhesive applicator device with adjustable slot nozzle with a partial section of the nozzle body, sliders and slider guides.
Figure 2:
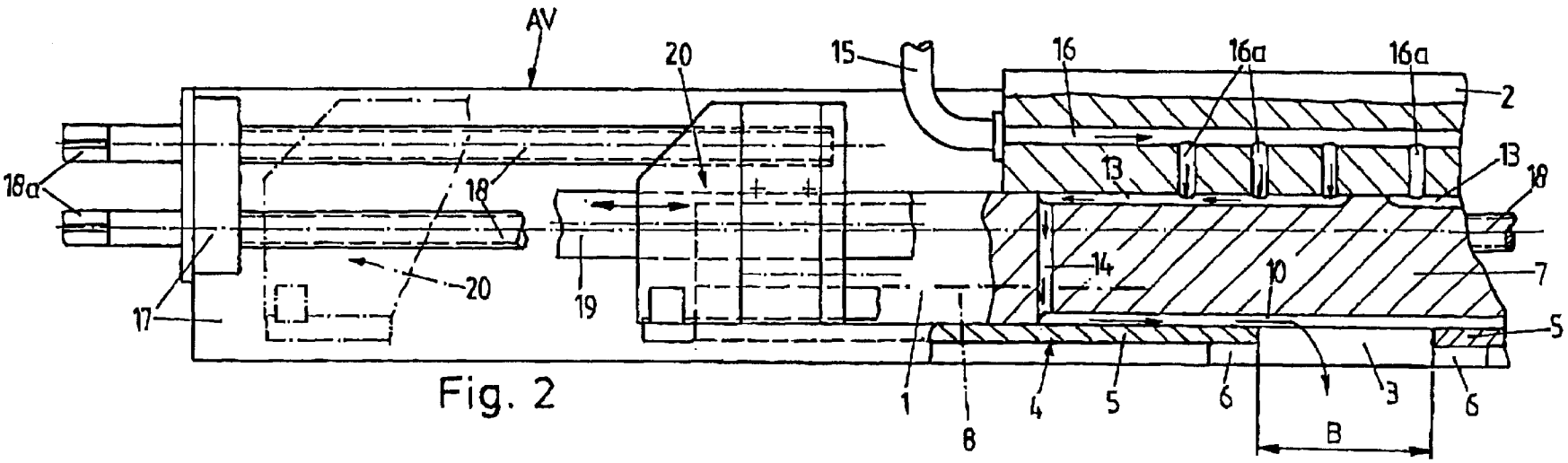
FIG. 2 shows a partial section of a side view of a longitudinal part of the applicator device.
Figure 3:
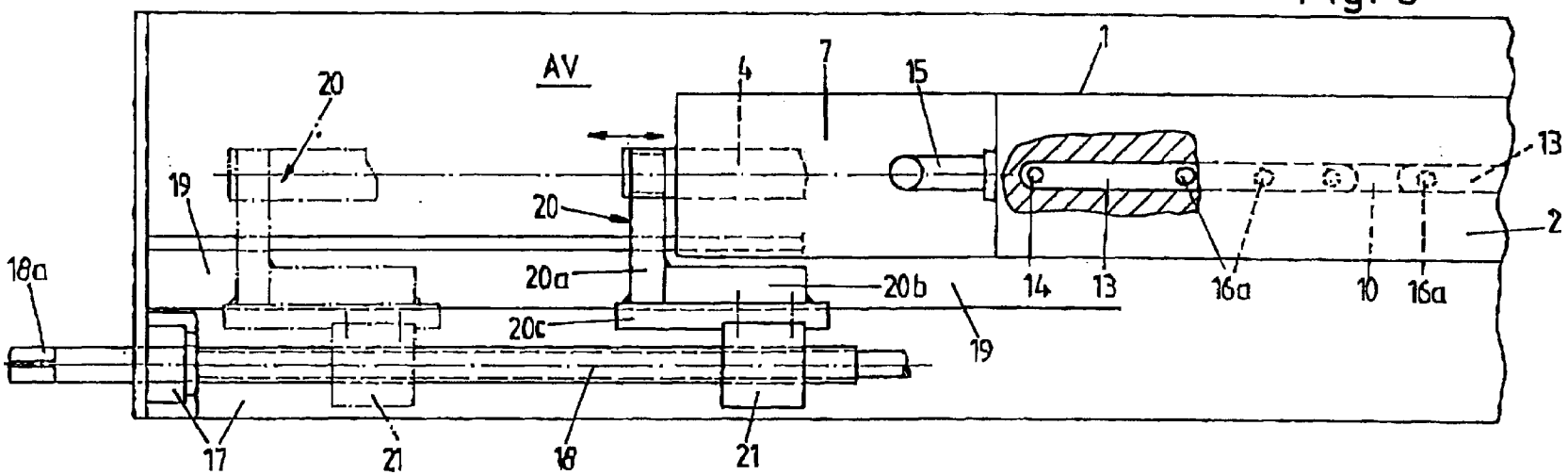
FIG. 3 shows a partial section of a top view of the device area according to FIG. 2.

The applicator device (AV) for applying hot-melt adhesive (HK) to work pieces (W) made of wood or wood material in the shape of rolls, strips, panels, etc. has a housing (1) with an adhesive feeder element (2) and an adjustable nozzle slot (3) for letting out the adhesive. The adhesive application width (B) of the nozzle slot (3) can be adjusted by means of two nozzle sliders (4) (also called "sliders") that can be displaced linearly in relation to each other.

The two nozzle sliders (4) are continuously adjustable to the width of the application (B), from a zero position to a maximum open position. The zero position is the centre point of the width of the nozzle slot (3) on which the ends of the two nozzle sliders (4) meet and close the nozzle slot (3). The two nozzle sliders (4) are displaced in opposite directions from this nozzle slot centre point up to the maximum displacement point, so that the nozzle slot (3) is completely open and has reached the maximum slot and application width (B).

The two nozzle sliders (4) can be synchronously adjusted to the respective application width (B).

In an advantageous embodiment, both the nozzle sliders (4) can be adjusted independently of each other.

In relation to each other, the two nozzle sliders (4) can be adjusted an equal distance or each a different distance from the centre (zero position) of the application width (B) of the nozzle slot (3).

This provides the possibility of adjusting only one nozzle slider (4) and not the other nozzle slider (4), or displacing one nozzle slider (4) more than the other. This permits a one-sided application of the glue or an application more on one side than the other in relation to the zero position.

The two nozzle sliders (4) are identically shaped with projecting flat tongues (6) on both adjacent ends of the slide strips (5), the tongues (6) projecting transversely to the longitudinal direction of the strips and forming tongue-shaped swords on the nozzle sliders (6).

The two slider strips (5) are each V-shaped in section and the tongue-shaped sword (6) projects at a corner of the triangle on a plane with the bisecting line of the section; the swords (6) are shaped like thin, rectangular or square plates.

The housing (1) consists of a block-shaped nozzle body (7) and two slider guides (8) shaped like sectional strips that are attached by means of screws (9) and leave the nozzle slot (3) exposed.

The opposing, flat triangular surface (5*a*) of the slider strips (5) that is above the tongue-shaped sword (6) is form-fittingly positioned on a flat surface (7*a*) of the nozzle body (7) (which has an adhesive exit channel (10)), and both the other flat triangular surfaces (5*b*) are form-fittingly positioned on opposing surfaces (8*a*) of both the slider guides (8); the tongues (6) of the slider strips (5) sit inside the nozzle slot (3) that is left exposed by the two slider guides (8).

On both sides of the nozzle slot (3) the two slider guides (8) have sealing strips (8*b*) that project slightly beyond the slider guides (8), each consisting of a single piece moulded to the strip-shaped slider guides (8) and which are angular, square or rectangular in section. The tongue-shaped swords (6) join flush with the exterior sides of the sealing strips (8*b*) that run transverse to the tongue plane.

On the outside of the slider guides (8) and the nozzle body (7) there is one width-stabilizing pressure pad (11), fastened lengthwise in the direction of the sliders by means of screws (12), for each of the opposing surfaces (8*a*) of the slider guides (8) for the slider strips (5).

On its surfaces (7*b*) opposite the sliders (4), the nozzle body (7) has two distributor channels (13) separated from each other and running in a common line from the centre of the width of the nozzle slot to roughly the maximum width of the nozzle slot, at each end of which (located at the maximum width of the slot) there is a branch channel (14) leading to an exit channel (10) running the length of the two distributor channels (13).

Connected to the nozzle body (7) is an adhesive feeder housing (2) with an exchangeable filter (2*a*), an adhesive feeding conduit (15) and feeding channels (16, 16*a*) leading to the distributor channels (13) in the nozzle body (7).

The feeding channels (16*a*) that discharge into the distributor channels (13) are located in a longitudinal area of the distributor channels (13) that is adjacent to the centre of the slot width and are, therefore, at a distance from the two branch channels (14) at the ends; this arrangement and design of the channels (16*a*, 13, 14 and 10) creates an adhesive guidance system in which the adhesive (HK) is constantly in motion on a relatively long circulation path to the nozzle slot (3), thereby preventing the adhesive (HK) from hardening in dead comers.

The two nozzle sliders (4) are independently and continuously adjustable, each having a manually crankable threaded spindle (18) sitting in a bracket (17) on the housing (1), whereby each slider (4) is coupled with a drive nut (21) on the threaded spindle (18) by means of a slideably attached transmission block (20) that is fastened to the end and fixed to a linear guide (19). The transmission block (20) consists of a lever (20*a*) fastened to the end of the slider strip, a guide block (20*b*) that runs in the linear guide (19) and that fixes the lever (20*a*) in place, and a connecting piece (20*c*) connecting the guide block (20*b*) with the nut (21).

The two threaded spindles (18) are turned by means of a handcrank (not shown) that is slipped onto the spindle (18) that is to be adjusted. The spindles (18) each have a slip-on-polygon (18*a*) at one end. As control ends, these spindle ends with the slip-on-polygon (18*a*) project side by side from one side of the device. The two spindles (18) are of different lengths, and one spindle (18) runs from the control end (spindle end) to the first slider (4), and the other, longer spindle (18) runs to the second slider (4).

(22) represents the electrical unit (23) for heating the adhesive (HK) and the pressure element for applying the adhesive (HK) under pressure.

Figure 6:
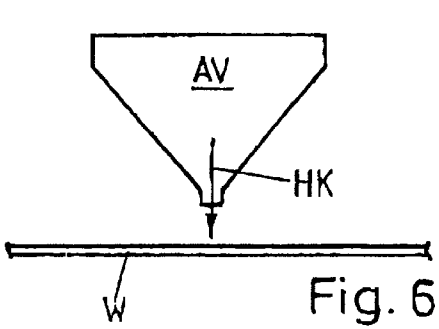
Figure 5:
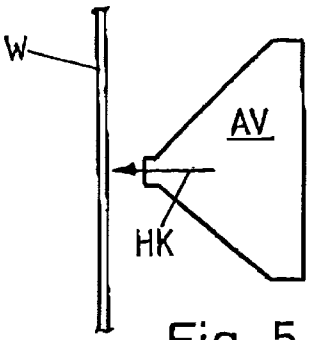
FIG. 5 show a diagram of the end views of a device applying adhesive and 6 horizontally (FIG. 5) and vertically (FIG. 6)
Figure 4:
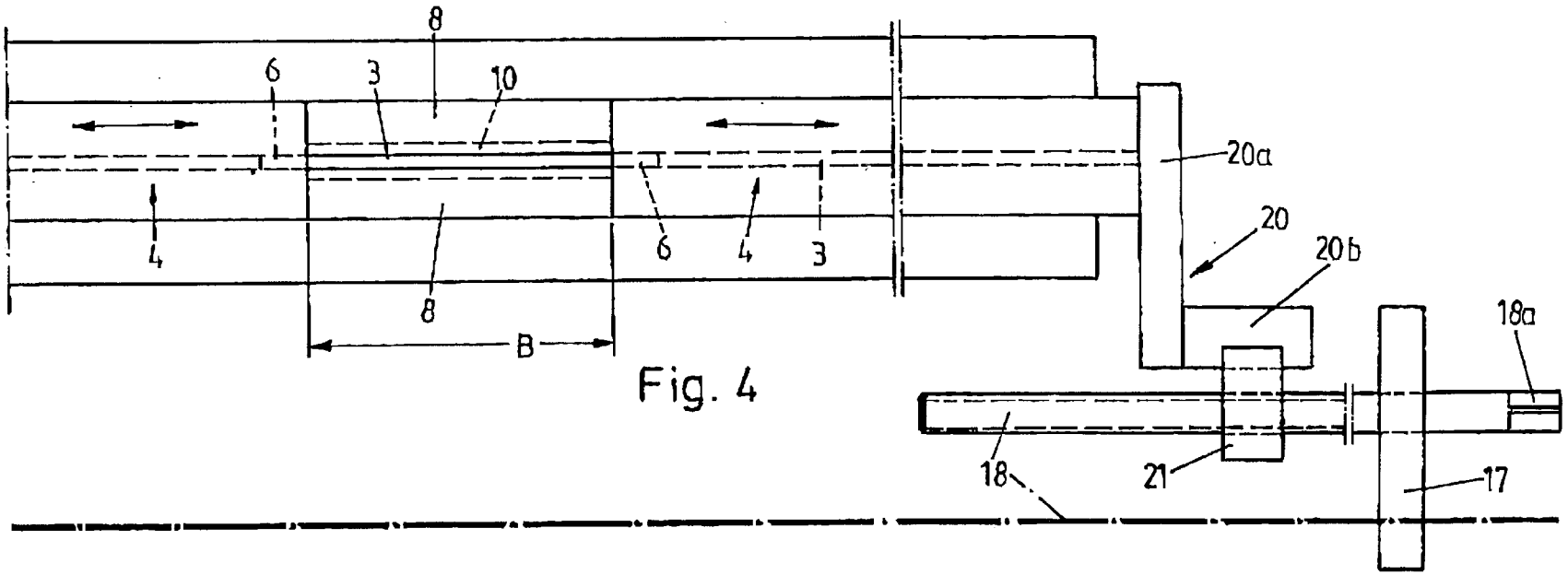
FIG. 4 shows a top view of a longitudinal part of the device with nozzle slot and sliders that are adjustable by means of threaded spindles.

The device (AV) operates advantageously with the adhesive application in horizontal direction and a vertically moving work piece (W) (FIG. 5), but can also operate as shown in FIG. 6 with vertical application of the adhesive onto the horizontally positioned/moving work piece (W).

Figure 7:
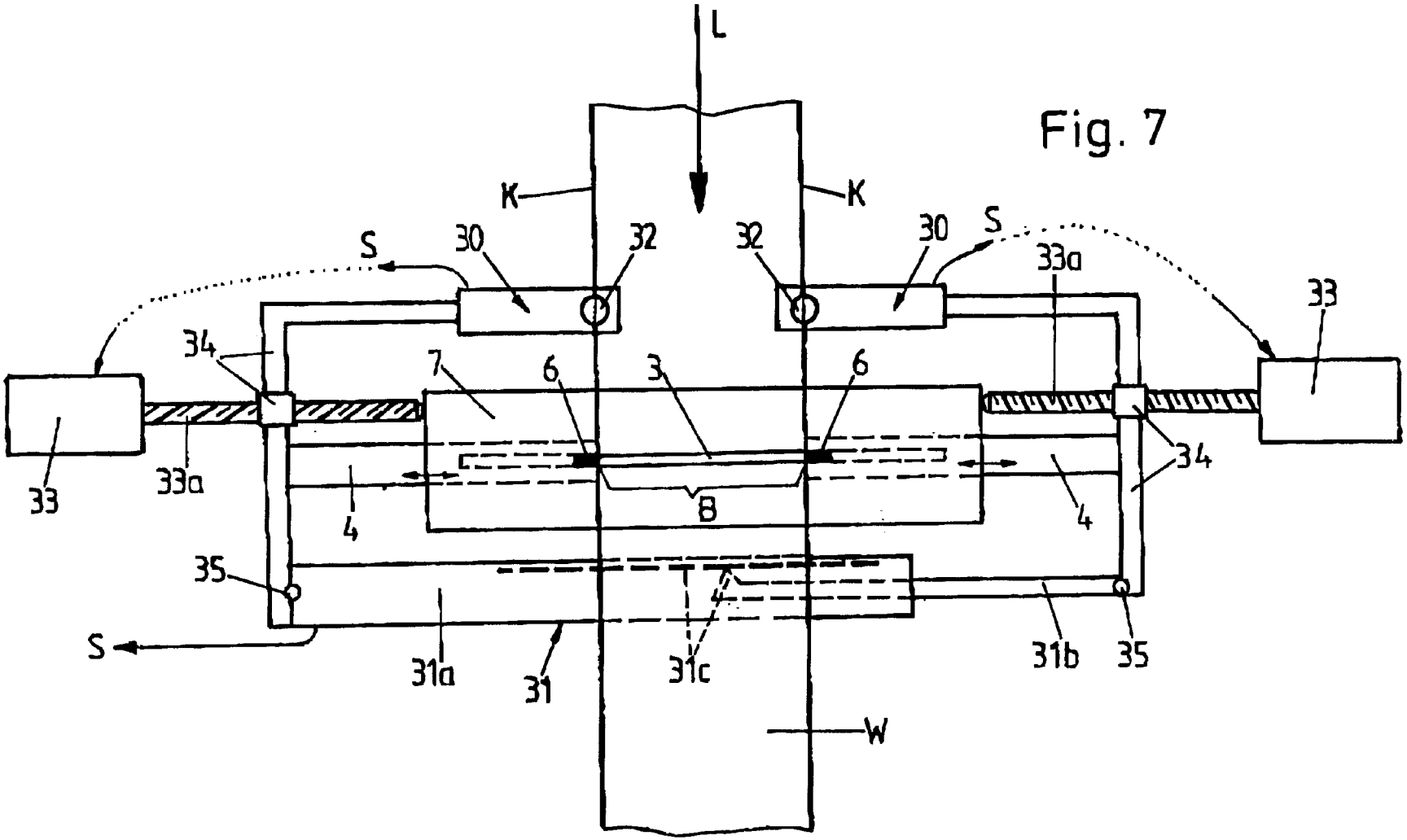
FIG. 7 shows a diagram representing the setting and adjustment of a nozzle slider by means of edge tracers and a distance pick-up.

FIG. 7 shows an arrangement for the electrical positioning of the nozzle sliders and setting of the working width of the device (AV) which is controlled by the work piece (W) passing through.

This arrangement permits the two nozzle sliders (4) to be independently adjusted to the width (B) of the nozzle slot (3) and its position in relation to the work piece (W) by means of the edge tracers (30) working with the edges (K) of the passing work piece (W), and/or the respective nozzle slot width (B) is measured by means of a distance pick-up (31) and the determined nozzle slot width (B) is transmitted as an electrical signal (S) to an adhesive dosing apparatus.

The two edge tracers (30) each have a sensor (32) that is controlled by the edge of the work piece (K) and are each mechanically connected to an actuator (33) that moves the nozzle slider (4) linearly.

By the degree to which the sensor (32) of the edge tracer (30) is covered by the edge (K) of the work piece, an electrical signal (S) is activated that is given to the actuator (33) for its direction of movement and travel distance in order to adjust the nozzle slider. The nozzle slider control depends on the degree to which the sensor (32) is covered by the edge of the work piece (K). If both sensors (32) are 50% covered by the assigned edge of the work piece (K), the work piece (W) is passing through normally, i.e. the width and the direction of movement (L) as well as the movement of the work piece are the same and no electrical signal is transmitted to the actuators (33) and the nozzle sliders (4) remain in their set positions and the nozzle slot (3) retains its width. If the width of the work piece (W) becomes greater or smaller or the direction of movement (L) of the work piece (W) changes to the left or the right or the movement of the work piece (W) zig-zags, one or the other of the sensors (32) will be more or less covered and the changed degree of coverage is registered and transmitted as an electrical signal (S) to one or the other or both actuators (33) to activate the actuators (33), whose respective direction of movement and opening and closing travel distance are controlled so that the nozzle sliders (4) are adjusted to the changed width (B) or position of the nozzle slot, either individually or synchronously. During this process, the bracket (34) is moved by an adjusting spindle (threaded spindle) **(33*a*) of the actuator (33), thereby linearly displacing the nozzle slider (4) that is fixed on the bracket (34), and its tongue-shaped sword (6)**.

The distance pick-up (31) is mechanically coupled with the two edge tracers (30) and changes its length according to the width of the nozzle slot (B) set by the edge tracers (30). This change in length, achieved by means of interlocking components **(31*a*, 31*b*) that can be extended and retracted like a telescope, determines the distance between the swords of the nozzle sliders (6) by means of electrical sliding contacts (31*c*) in the distance pick-up (31)** and transmitted as an electrical signal (S) to the adhesive dosing control above (not shown).

Each edge tracer (30) is mounted to a bracket (34), each bracket (34) is movably connected to the actuator (33) and rigidly connected to a nozzle slider (4), and the distance pick-up (31), which can be moved or whose length can be changed, is arranged between the two brackets (34), and its two longitudinal ends are fastened to connection points (35) on the brackets (34).

Thus the distance pick-up (31) is moved along by the brackets (34) according to the adjustment of the nozzle sliders (4), i.e. retracted or extended, thereby determining the absolute distance between the tongue-shaped swords (6) of the nozzle sliders (4) which delimit the adjusted slot width.

The distance pick-ups (31) always determine the absolute width of the application slot (3), and the corresponding amount of adhesive is applied across the precise width of the work piece (W), controlled by means of the adhesive dosing apparatus; thus the application width, length and amount is always optimal.

Other conventional measuring systems can also be used as distance pick-ups (31).

The motor actuators (33) in an arrangement according to FIG. 7 are positioned co-axially in relation to each other, and their adjusting spindles **(933*a*)** are also arranged co-axially.

The actuators (33) can be arranged on, but beside, the distance pick-up (31), and are driven by a wrap drive such as a toothed belt, chain, etc. from the driving pinion of the actuator (33) to a gearwheel (not shown) located on the adjusting spindle **(33*a*)**.

The edge tracers (30) and the distance pick-up (31) can be jointly assigned to the adhesive application device, or the distance pick-up (31) optionally assigned to the application device (AV) when adjusting manually.

What is claimed is:

1. Applicator device for hot-melt adhesive (HK) with a housing (1) with an adhesive feeder element (2) and a nozzle body (7) with branch channels (14) and an adjustable nozzle slot (3) to the adhesive's exit, into which linearly adjustable nozzle sliders(4) project inward and each form a seal with a tongue-shaped sword (6) that projects from a slider strip (5), characterized in that the slider strips (5) adjoin a surface **(7*a*) of the nozzle body (7) and in which/between it and the slider strips (5) there is an adhesive exit channel (10) running across a maximum nozzle slot width which is fed at each end from the branch channels (14), and wherein the two slider strips (5) are each triangularly V-shaped in section and that the sword (6)** projects at a corner of the triangle on a plane with the bisecting line of the section.

2. Applicator device according to claim 1, characterized in that the housing (1) consists of a block-shaped nozzle body (7) and two slider guides (8) fastened to it and shaped like sectional strips that leave the nozzle slot (3) exposed.

3. Applicator device according to claim 2, characterized in that the two slider guides (8) on both sides of the nozzle slot (3) each have a sealing strip **(8*b*) projecting slightly beyond the slider guides (8), between which the tongue-shaped swords (6)** sit flush with the exterior of the nozzle slot.

4. Applicator device according to claim 2, characterized in that the slider strips (5) with their flat triangular surface **(5*a*) that is opposite the tongue-shaped sword (6) adjoin the flat surface (7*a*) of the nozzle body (7) which has the adhesive exit channel (10), and both their other flat triangular surfaces (5*b*) are form-fittingly positioned on opposing surfaces (8*a*) of the two slider guides (8); their swords (6) sit inside the nozzle slot (3) that is left exposed by the two slider guides (8)**.

5. Applicator device according to claim 4, characterized in that the two slider guides (8) on both sides of the nozzle slot (3) each have a sealing strip **(8*b*) projecting slightly beyond the slider guides (8), between which the tongue-shaped swords (6)** sit flush with the exterior of the nozzle slot.

6. Applicator device according to claim 5, characterized in that pressure pads (11) are fastened on the outside of the slider guides (8) and the nozzle body (7), which stabilize the width of the opposing surfaces **(8*a*) of the slider guides (8) for the slider strips (5)**.

7. Applicator device according to claim 6, characterized in that on its surfaces **(7*b*) opposite the sliders (4), the nozzle body (7) has two distributor channels (13) separated from each other and running in a common line from the centre of the width of the nozzle slot to roughly the maximum width of the nozzle slot, from each end (located at the maximum width of the slot) of which the branch channels (14)** are fed.

8. Applicator device according to claim 7, characterized in that, connected to the nozzle body (7), there is an adhesive feeder housing with an exchangeable filter **(2*a*) and an adhesive feeding conduit (15) and channels (16, 16*a*) leading to the distributor channels (13) in the nozzle body (7), whereby the feeding channels (16*a*) that discharge into the distributor channels (13) are arranged in a longitudinal area of the distributor channels (13)** that is adjacent to the center of the slot width.

9. Applicator device according to claim 8, characterized in that the two nozzle sliders (4) are independently and continuously adjustable each by having a manually crankable threaded spindle (18) sitting in a bracket (17) on the housing (1), whereby each slider (4) is coupled with a drive nut (21) by a slideably attached transmission block (20) that is fastened at the end and fixed to a linear guide (19) and whereby the transmission block (20) consists of a lever **(20*a*) fastened to the end of the slider strip, a guide block (20*b*) that runs in the linear guide (19) and that fixes the lever (20*a*) in place, and a connecting piece (20*c*) connecting the guide block (20*b*) with the nut (21)**.

10. Applicator device according to claim 9, characterized in that the two nozzle sliders (4) can be independently adjusted to a width (B) of the nozzle slot (3) and its position in relation to a work piece (W) by edge tracers (30) working with the edges (K) of the passing work piece (W), and/or the respective nozzle slot width (B) is transmitted as an electrical signal (S) to an adhesive dosing apparatus by means of distance pick-ups (31).

11. Applicator device according to claim 10, characterized in that a distance pick-up (31) is mechanically coupled with the two edge tracers (30) and changes its length according to a width of the nozzle slot (B) set by the edge tracers (30), thus determining an absolute distance between the nozzle sliders (4) and transmitting it as an electrical signal (S) to the adhesive dosing control.

12. Applicator device according to claim 11, characterized in that each edge tracer (30) is mounted to a bracket (34), each bracket (34) is movably connected to the actuator (33) and rigidly connected to a nozzle slider (4), and the distance pick-up (31), whose length can be changed, is arranged between the two brackets (34), and its two longitudinal ends are fastened to connection points (35) on the brackets (34).

13. Applicator device according to claim 10, characterized in that by a degree to which a sensor (32) of the edge tracer (30) is covered by the edge (K) of the work piece an electrical signal (S) is activated that is given to an actuator (33) for its direction of movement and travel distance.

14. Applicator device according to claim 10, characterized in that each edge tracer (30) is mounted to a bracket (34), each bracket (34) is movably connected to an actuator (33) and rigidly connected to a nozzle slider (4), and a distance pick-up (31), whose length can be changed, is arranged between the two brackets (34), and its two longitudinal ends are fastened to connection points (35) on the brackets (34).

15. Applicator device according to claim 10, characterized in that the two edge tracers (30) each have a sensor (32) that is controlled by the edge of the work piece (K) and are each mechanically connected to an actuator (33) that moves the nozzle slider (4) linearly.

16. Application device according to claim 15, characterized in that by a degree to which the sensor (32) of the edge tracer (30) is covered by the edge (K) of the work piece an electrical signal (S) is activated that is given to the actuator (33) for its direction of movement and travel distance.

17. Applicator device for hot-melt adhesive (HK) with a housing (1) with an adhesive feeder element (2) and a nozzle body (7) with branch channels (14) and an adjustable nozzle slot (3) to the adhesive's exit, into which linearly adjustable nozzle sliders(4) project inward and each form a seal with a tongue-shaped sword (6) that projects from a slider strip (5), characterized in that the slider strips (5) adjoin a surface **(7*a*) of the nozzle body (7) and in which/between it and the slider strips (5) there is an adhesive exit channel (10) running across a maximum nozzle slot width which is fed at each end from the branch channels (14), and wherein connected to the nozzle body (7), there is an adhesive feeder housing (2) with an exchangeable filter (2*a*) and an adhesive feeding conduit (15) and feeding channels (16, 16*a*) leading to distributor channels (13) in the nozzle body (7), whereby the feeding channels (16*a*) that discharge into the distributor channels (13) are arranged in a longitudinal area of the distributor channels (13)** that is adjacent to the center of the slot width.

* * * * *